US010633917B2

(12) United States Patent
de Vries et al.

(10) Patent No.: US 10,633,917 B2
(45) Date of Patent: Apr. 28, 2020

(54) DEVICE FOR MANUALLY OPERATING A MOTORIZED DRIVE OF A SCREEN, SUCH AS A WINDOW COVERING, AND METHOD FOR SAVING SETTING VALUES ASSOCIATED WITH DIFFERENT POSITIONS OF THE SCREEN

(71) Applicant: Coulisse B.V., Enter (NL)

(72) Inventors: Ruben Hubert Jan de Vries, Zevenaar (NL); Bastiaan Franciscus Klein Tuente, Groenlo (NL); Harry Davids, Utrecht (NL); Wouter Hendriks, Enschede (NL)

(73) Assignee: Coulisse B.V., Enter (NL)

( * ) Notice: Subject to any disclaimer, the term of this patent is extended or adjusted under 35 U.S.C. 154(b) by 170 days.

(21) Appl. No.: 15/458,776

(22) Filed: Mar. 14, 2017

(65) Prior Publication Data

US 2017/0268293 A1 Sep. 21, 2017

(30) Foreign Application Priority Data

Mar. 17, 2016 (NL) ..... 2016447
Dec. 23, 2016 (EP) ..... 16206681

(51) Int. Cl.
*E06B 9/68* (2006.01)
*E06B 9/74* (2006.01)
(Continued)

(52) U.S. Cl.
CPC ..... *E06B 9/74* (2013.01); *E06B 9/42* (2013.01); *E06B 9/68* (2013.01); *E06B 9/72* (2013.01);
(Continued)

(58) Field of Classification Search
CPC ..... E06B 9/74; E06B 9/78; E06B 9/72; E06B 9/68; E06B 2009/6818; E06B 2009/785;
(Continued)

(56) References Cited

U.S. PATENT DOCUMENTS 2,936,353 A * 5/1960 Hanlet ..... H01H 36/0073 335/147
4,296,394 A * 10/1981 Ragheb ..... H01H 5/02 200/404
4,372,367 A * 2/1983 Baldanello ..... E06B 9/74 160/310
4,476,910 A * 10/1984 Saito ..... E06B 9/50 160/291
(Continued)

FOREIGN PATENT DOCUMENTS

EP 0671676 A1 * 9/1995 ..... G05B 19/231
EP 0936342 A1 8/1999
(Continued)

OTHER PUBLICATIONS

Dutch Patent Office Search Report for application 2016447, dated Nov. 7, 2016.
(Continued)

*Primary Examiner* — Johnnie A. Shablack
(74) *Attorney, Agent, or Firm* — Oppedahl Patent Law Firm LLC

(57) ABSTRACT

A motorized drive of a window covering provided with a device for manually operating the motorized drive comprising a housing to be attached to the window covering with a pull cord and a push button for manual operation. A switch converts pulling movements on the pull cord into first electrical signals for the motorized drive.
Controls are configured to save a setting value associated with a current position of the window covering in a data memory after receiving second electrical signals from the push button.
A method for saving setting values associated with different positions of the window covering provided with the motorized drive comprising the steps of saving a current position by manual operation of the pull cord and/or the push button.

15 Claims, 6 Drawing Sheets

(51) Int. Cl.
*E06B 9/42* (2006.01)
*E06B 9/72* (2006.01)
*E06B 9/78* (2006.01)
*H01H 17/20* (2006.01)

(52) U.S. Cl.
CPC ..... *E06B 9/78* (2013.01); *E06B 2009/6818* (2013.01); *E06B 2009/785* (2013.01); *H01H 17/20* (2013.01)

(58) Field of Classification Search
CPC .. E06B 2009/689; H01H 17/20; H01H 17/00; H01H 17/02; H01H 17/04; H01H 17/06; H01H 17/08; H01H 17/16; H01H 17/165; H01H 17/18; H01H 17/24
USPC ..... 160/310
See application file for complete search history.

(56) References Cited

U.S. PATENT DOCUMENTS 5,252,794 A * 10/1993 Tseng ..... H01H 17/06 200/11 A
5,278,366 A * 1/1994 Fleischhauer ..... H01R 33/9555 200/51.03
5,278,480 A * 1/1994 Murray ..... G05B 19/42 318/266
5,517,094 A * 5/1996 Domel ..... E06B 9/307 160/168.1 P
5,793,174 A * 8/1998 Kovach ..... E06B 9/262 318/16
5,848,634 A * 12/1998 Will ..... E06B 9/174 160/310
5,990,646 A * 11/1999 Kovach ..... E06B 9/262 318/16
6,057,658 A * 5/2000 Kovach ..... E06B 9/262 318/16
6,181,089 B1 * 1/2001 Kovach ..... E06B 9/262 318/16
6,201,364 B1 * 3/2001 Will ..... E06B 9/174 160/1
6,259,218 B1 * 7/2001 Kovach ..... E06B 9/262 318/16
6,283,190 B1 * 9/2001 Hu ..... E06B 9/32 160/168.1 P
6,369,530 B2 * 4/2002 Kovach ..... E06B 9/32 318/16
6,392,374 B1 5/2002 Menetrier et al.
6,867,565 B2 * 3/2005 Maistre ..... G05B 19/42 318/265
6,910,515 B2 * 6/2005 Nien ..... E06B 9/32 160/168.1 P
7,399,940 B1 * 7/2008 Tseng ..... H01H 17/18 200/51.11
7,652,439 B2 * 1/2010 Tang ..... F04D 25/088 318/162
7,723,939 B2 * 5/2010 Carmen, Jr. ..... H02K 11/022 318/16
8,091,604 B2 * 1/2012 Kluck ..... A47H 5/0325 160/1
8,461,784 B2 * 6/2013 Skinner ..... E06B 9/322 318/16
8,522,852 B2 * 9/2013 Yu ..... E06B 9/322 160/170
8,723,454 B2 * 5/2014 Skinner ..... E06B 9/322 318/16
8,844,605 B2 * 9/2014 Ng ..... E06B 9/42 160/170
9,181,750 B2 11/2015 Ticoalu et al.
9,187,951 B2 * 11/2015 Yu ..... E06B 9/322
9,334,688 B2 * 5/2016 Colson ..... E06B 9/42
9,453,370 B2 * 9/2016 Bohlen ..... E06B 9/68
9,489,834 B2 * 11/2016 Hall ..... G01R 19/0092
9,540,871 B2 * 1/2017 Hall ..... E06B 9/303
9,605,476 B2 * 3/2017 Hall ..... E06B 9/303
9,644,424 B2 * 5/2017 Slivka ..... E06B 9/42
9,759,010 B2 * 9/2017 Hall ..... E06B 9/303
9,765,568 B2 * 9/2017 Colson ..... E06B 9/42
9,790,739 B2 * 10/2017 Colson ..... E06B 9/42
9,840,870 B2 * 12/2017 Lu ..... E06B 9/40
10,104,997 B2 * 10/2018 Pham ..... A47H 5/0325
10,273,751 B2 * 4/2019 Colson ..... E06B 9/42
10,358,867 B2 * 7/2019 Hall ..... E06B 9/34
2001/0015632 A1 8/2001 Norbert et al.
2002/0190678 A1 * 12/2002 Huber ..... E06B 9/32 318/434
2005/0099151 A1 * 5/2005 Lee ..... E06B 9/68 318/640
2008/0053805 A1 * 3/2008 Wanek ..... H01H 9/06 200/336
2008/0129431 A1 * 6/2008 Onodera ..... H01H 9/0005 335/205
2011/0037544 A1 * 2/2011 Tinius ..... H01H 17/20 335/205
2011/0265958 A1 * 11/2011 Skinner ..... E06B 9/322 160/127
2012/0167702 A1 * 7/2012 Dangel ..... E06B 9/68 74/405
2013/0020969 A1 * 1/2013 Leivenzon ..... E06B 9/68 318/16
2013/0269887 A1 * 10/2013 Skinner ..... E06B 9/322 160/331
2014/0076505 A1 * 3/2014 Mullet ..... E06B 9/72 160/108
2014/0090787 A1 * 4/2014 Colson ..... E06B 9/68 160/7
2015/0007946 A1 * 1/2015 Yu ..... E06B 9/38 160/84.02
2015/0191972 A1 * 7/2015 Malekpour ..... E06B 9/36 160/1
2015/0284998 A1 10/2015 Hall et al.
2017/0089129 A1 * 3/2017 Hall ..... E06B 9/303
2017/0089133 A1 * 3/2017 Watkins ..... E06B 9/42
2017/0095103 A1 * 4/2017 Pham ..... A47H 5/0325
2017/0107758 A1 * 4/2017 Hall ..... E06B 9/303
2017/0145740 A1 * 5/2017 Hall ..... E06B 9/303
2017/0204661 A1 * 7/2017 Dann ..... E06B 9/74
2018/0002981 A1 * 1/2018 Colson ..... E06B 9/32
2018/0058143 A1 * 3/2018 Selogy ..... E06B 9/322
2018/0106105 A1 * 4/2018 Anthony ..... E06B 9/72
2018/0128048 A1 * 5/2018 Pinese ..... E06B 9/88
2018/0174781 A1 * 6/2018 Fangmann ..... E06B 9/72
2018/0216404 A1 * 8/2018 Fisher ..... E06B 9/60
2018/0347273 A1 * 12/2018 Rieper ..... E06B 9/32
2019/0040676 A1 * 2/2019 Mullet ..... E06B 9/322
2019/0150651 A1 * 5/2019 Pham ..... E06B 9/368

FOREIGN PATENT DOCUMENTS

EP 1182321 A1 2/2002
EP 1365101 A2 11/2003
EP 1367471 A1 * 12/2003 ..... G05B 19/42
EP 2161818 A1 * 3/2010 ..... E06B 9/72
EP 3128115 A4 * 4/2017 ..... E06B 9/40
WO 2004007891 A1 1/2004
WO WO-2004013880 A1 * 2/2004 ..... H01H 13/562

OTHER PUBLICATIONS

European Patent Office Search Report for application EP 16206681, dated Aug. 8, 2017.
Machine translation of EP 1182321.
Machine translation of EP 0936342.
Machine translation of EP 1365101.

* cited by examiner

DEVICE FOR MANUALLY OPERATING A MOTORIZED DRIVE OF A SCREEN, SUCH AS A WINDOW COVERING, AND METHOD FOR SAVING SETTING VALUES ASSOCIATED WITH DIFFERENT POSITIONS OF THE SCREEN

The invention relates to a device for manually operating a motorized drive of a screen, such as a window covering, comprising a housing to be attached to the shaft of the screen;

first operating means for manual operation of the device by means of pulling movements by a user;

switching means for converting the pulling movements on the first operating means into first electrical signals for the motorized drive.

Such a device is known in the relevant field, for instance from EP1182321. In the known device the switching means comprise electrical contacts which make direct contact with an electric motor.

The known device combines the advantages of an electric motor with the convenience of use of a traditional operation with pulling movements on a cord. The pull cord moreover requires no loop, whereby the known device also meets the current requirements in the field of child safety.

The present invention has for its object to further improve the device according to the preamble.

The device according to the invention has for this purpose the feature that the switching means comprise a switch which generates a first electrical signal in a first mode and generates a second electrical signal in a second mode, wherein the switching means further comprise a switching element for connection to the first operating means, wherein the switching element is movable between a first position, in which the switch takes up the first mode, and a second position in which the switching element activates the switch in the second mode, and the device comprises control means for controlling the motorized drive on the basis of the first electrical signals.

The switching means comprise only one switching element and a switch, and can therefore take a compact form. The addition of control means, preferably a microprocessor, increases the possibilities of the device according to the invention and makes it applicable in diverse types of motorized transmission.

In an optimal preferred embodiment of the device according to the invention the switching element is a rotation element, which rotation element is rotatable about a rotation axis running substantially parallel to the screen shaft. The rotatable switching element has the significant advantage that the pulling movement is converted into a rotational movement, during which the rotation element is moved along the switch, which enables the switching means to take a very compact form.

According to an elegant preferred embodiment of the device according to the invention, the rotation element comprises a central body with a first radially protruding lip.

According to a practical preferred embodiment of the device according to the invention, the rotation element comprises a central body with a second radially protruding lip for connection to the manual operating means.

In a further preferred embodiment the device according to the invention comprises biasing means for urging the rotation element into the first position. The biasing means make it possible to set the required tensile force.

In a first preferred embodiment of the device according to the invention the switch comprises a sensor and the switching element comprises a number of associated signal generators. The switching means take a contactless form, this resulting in reduced wear and a longer lifespan. According to an advantageous and reliable development of the first preferred embodiment, the switch comprises a magnetic sensor and the switching element comprises a number of magnets. In an energy-saving embodiment the magnetic sensor is a Hall sensor. In an elegant and compact preferred embodiment one or more of the magnets are arranged on the first radially protruding lip of the switching element embodied as rotation element.

In a second preferred embodiment of the device according to the invention the switching means comprise a switch configured to perform a translating movement between the first mode and the second mode, wherein the switching element is movable between a first position, in which the switching element does not make contact with the switch, and a second position in which the switching element makes contact with the switch for actuating the translating movement of the switch. The switching element and the switch are movable along substantially parallel movement axes and the switching means can therefore take a very compact form. The device according to the invention, wherein the switching element is a rotation element, further has the significant advantage that the rotation element slides along the switch, whereby the switching means do not transmit the tensile force on the cord directly to the switch. Overloading of the switch is thereby prevented.

In a preferred embodiment of the device according to the invention the rotation element has an at least partially non-uniform thickness. The non-uniform thickness ensures a gradual force transmission to the switch when the rotation element slides over the switch.

According to a further preferred embodiment, the first mode is an OFF-mode in which the switch does not generate an electrical signal and the second mode is an ON-mode in which the switch generates an electrical signal.

The switch is preferably configured to close an electrical circuit in which a power supply and the motorized drive are incorporated.

The invention also relates to a device according to the preamble of claim 1, characterized in that the device is further provided with second operating means for generating second electrical signals, which second operating means are manually operable, wherein the control means are configured to save a setting value associated with a current position of the screen in the memory means after receiving the second electrical signals.

The improved device according to the invention has the advantage that programming of a current mode of the screen can take place directly in manual manner. This enhances the convenience of use and the user-friendliness. In an elegant preferred embodiment the second operating means comprise an operating button, preferably a push button.

According to an elegant preferred embodiment, the current position of the screen is a first or a second end position which bounds the movement of the screen.

The control means preferably comprise a microcontroller for controlling the motorized drive. In a first preferred embodiment of the device according to the invention which is safe for children the operating means comprise a cord or chain.

In a second preferred embodiment of the device according to the invention which is safe for children the operating means comprise a rod.

In a preferred embodiment the screen is a roller blind and the device according to the invention is further provided with a motor unit which is coupled to the housing, wherein the motor unit comprises a tubular motor housing for the motorized drive, which is to be received in a roller blind tube.

The invention likewise relates to a method for saving setting values associated with different positions of a screen, such as a window covering, which screen is provided with a motorized drive and a device according to the invention, comprising the step of saving a current position by manually operating the first operating means and/or the second operating means. The method according to the invention has the significant advantage that programming of screen positions can always take place directly, without the device having to be brought into a programming mode. The manual operation provides here an improved user-friendliness and an improved convenience of use.

The invention will now be described with reference to the figures, in which

Figure 1:
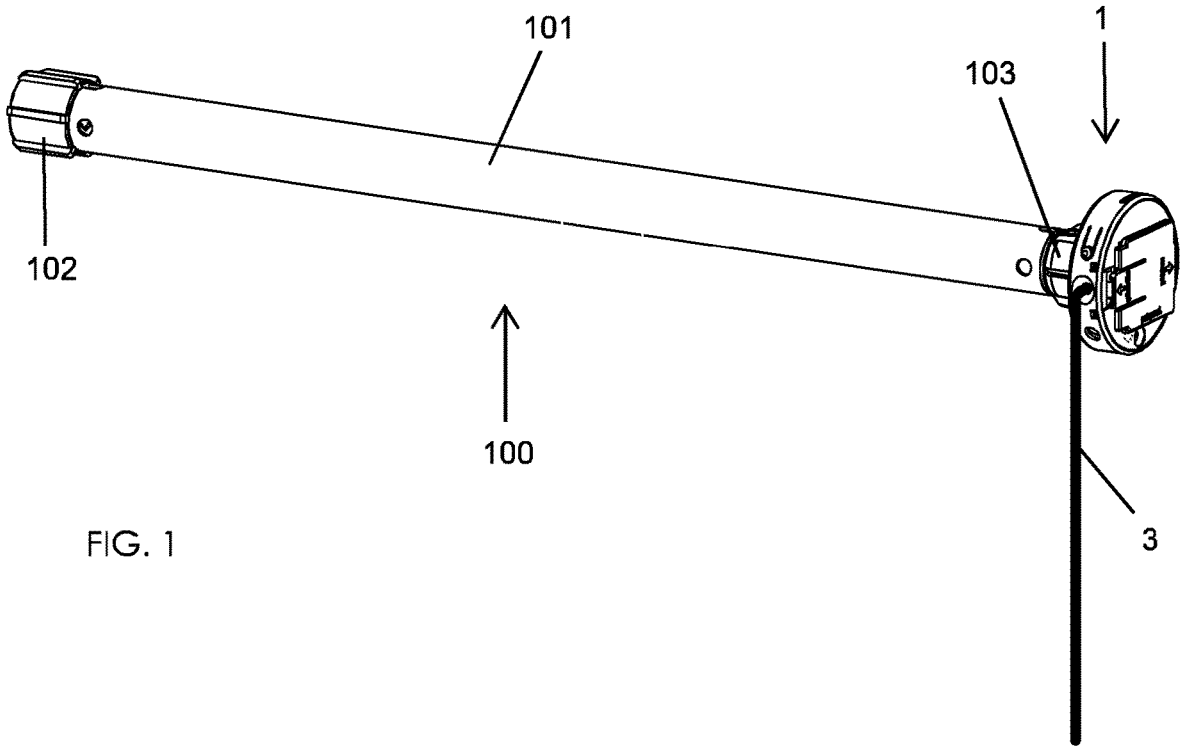
FIG. 1 shows a schematic view of a preferred embodiment of the device according to the invention incorporated in a motor unit for a roller blind.

FIG. 1 shows a schematic view of a preferred embodiment of a device 1 for manually operating a motorized drive of a screen, such as a window covering. In the shown preferred embodiment device 1 is intended for operating a roller blind. FIG. 1 shows a motor unit 100 with a generally tubular motor housing 101 to be received in a roller blind tube (not shown). Situated in motor housing 101 is a motorized drive, such as an electric motor. This electric motor drives a drive plug 102 which is situated at the outer end of motor housing 101. Situated at the opposite outer end is a crown or slide bearing 103, as well as a device 1 according to the invention. Device 1 can be operated by means of a pull cord 3.

Figure 2:
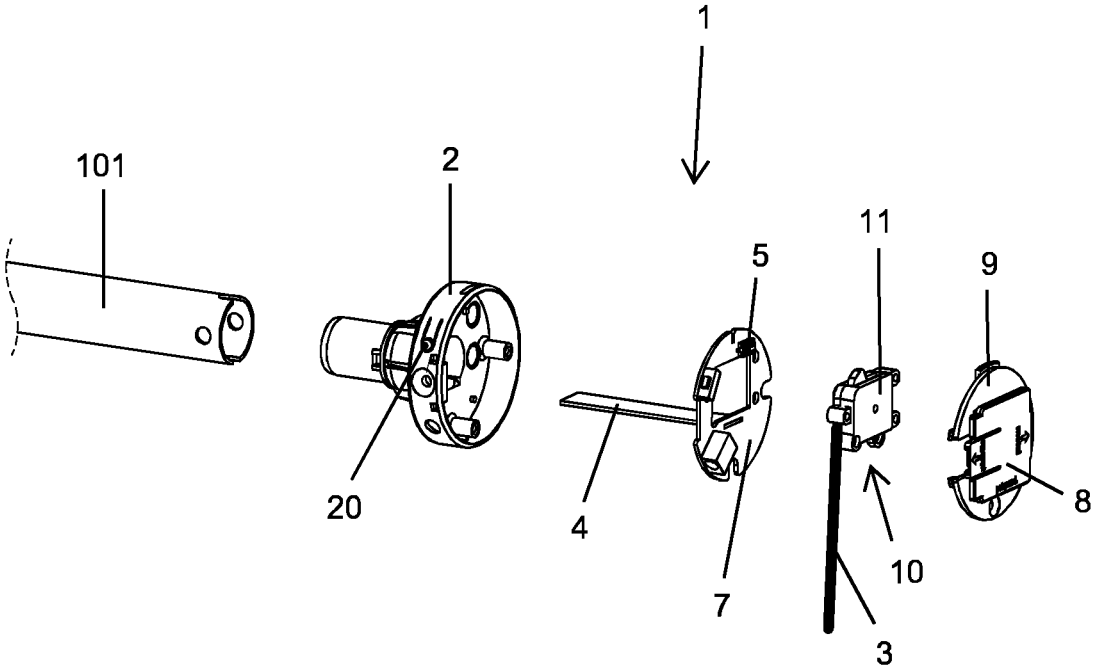
FIG. 2 shows a schematic view of the device of FIG. 1 with exploded parts.

FIG. 2 shows a schematic view of device 1 of FIG. 1 with exploded parts. Device 1 comprises a housing 2 to be attached to the screen, in this preferred embodiment to be received in motor housing 101. Device 1 further comprises control means 4 for controlling the motorized drive. Suitable control means 4 are for instance a microcontroller.

Device 1 further comprises switching means for converting the pulling movements on pull cord 3 into electrical signals. The switching means comprise a (pressure) switch 5 which is configured to perform a translating movement between a first mode and a second mode. The first mode is preferably an OFF-mode in which the pressure switch does not generate an electrical signal. The second mode is preferably an ON-mode in which the pressure switch does generate an electrical signal. Pressure switch 5 can for instance close an electrical circuit in which the electric motor and control means 4 are incorporated together with a power supply. The switch is preferably a microswitch. The switching means further comprise switching means in the form of a mechanical switching mechanism 10 for operating pressure switch 5 with pull cord 3.

Control means 4 and pressure switch 5 are arranged on a mounting plate 7. Housing 2 further comprises a closing plate 9 with mounting means 8 for mounting the roller blind on a surface.

Figure 3:
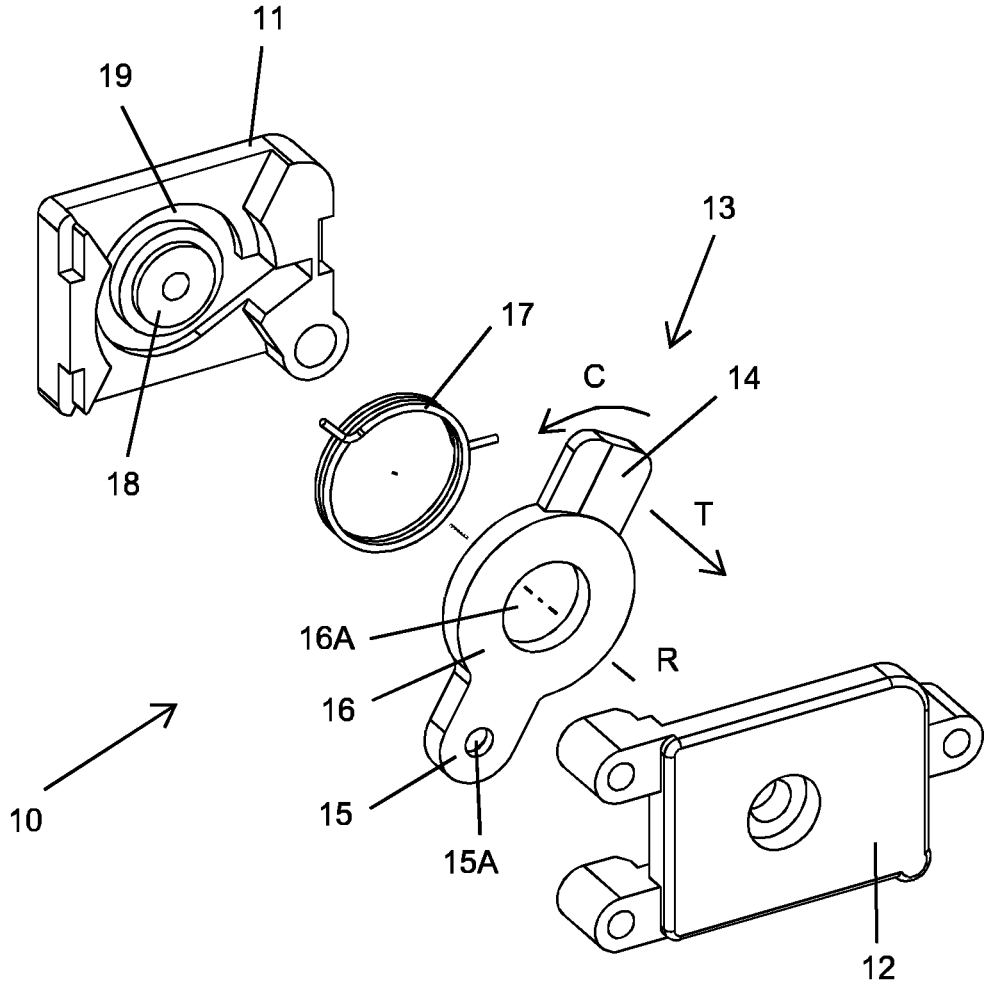
FIG. 3 shows a schematic view of a part of the device of FIG. 2 with exploded parts.

FIG. 3 shows the mechanical switching mechanism 10 with exploded parts. Switching mechanism 10 comprises a first housing part 11 and a second housing part 12, which enclose a rotation element 13 and biasing means 17. Rotation element 13 has a central body 16 with a central opening 16A and is rotatable in rotation direction C about a rotation axis R. A first lip 14 extends in radial direction from central body 16. First lip 14 has an at least partially non-uniform thickness which increases counter to the rotation direction C. This can be achieved by a chamfering of first lip 14. A second lip 15 extends in radial direction from central body 16. Second lip 15 is provided with an eye 15A for attachment of pull cord 3. First housing part 11 is provided with a shaft 18 to be received in the central opening 16A of rotation element 13. A groove 19 for receiving biasing means 17 runs around shaft 18. In the shown preferred embodiment the biasing means comprise a torsion spring.

Figure 4A:
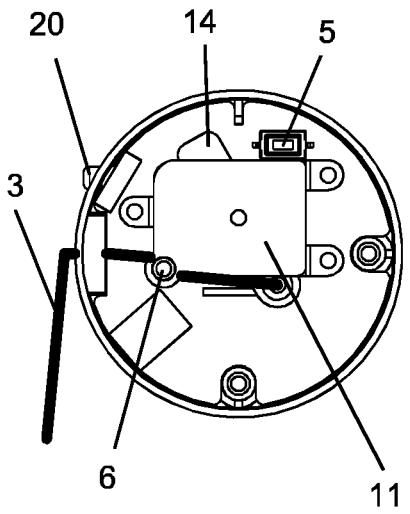
FIG. 4A shows a schematic cross-sectional view through the device according to FIG. 1 in a first position.
Figure 4B:
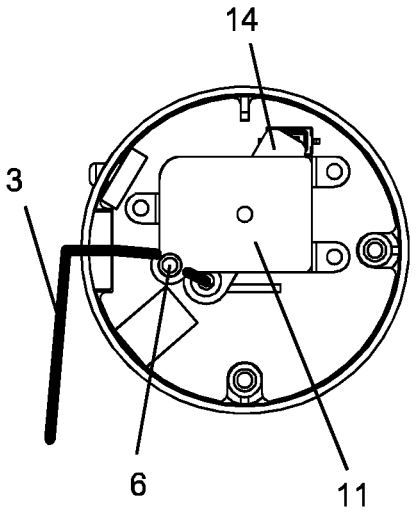
FIG. 4B shows a schematic cross-sectional view through the device according to FIG. 1 in a second position.

FIGS. 4A and 4B each show a schematic cut-away view of device 1, wherein switching mechanism 10 is assembled in housing 2. Pressure switch 5 is situated in housing 2. Situated some distance from pressure switch 5 is a bushing 6. In assembled state of device 1 bushing 6 serves to guide pull cord 3.

FIG. 4A shows rotation element 13 in a first position. Operating pull cord 3 causes rotation element 13 to move to the second position shown in FIG. 4B. After pull cord 3 is released the rotation element will return to the position in FIG. 4A under the influence of biasing means 17. During movement of rotation element 13 first lip 14 slides over pressure switch 5, as a result of which this performs a translating movement in the direction T. The direction T runs substantially parallel to the direction of rotation axis R. Pressure switch 5 is in this way operated by pulling movements on pull cord 3. Pressure switch 5 is in electrical connection with control means 4, which are in electrical connection with the motorized drive.

Figure 5:
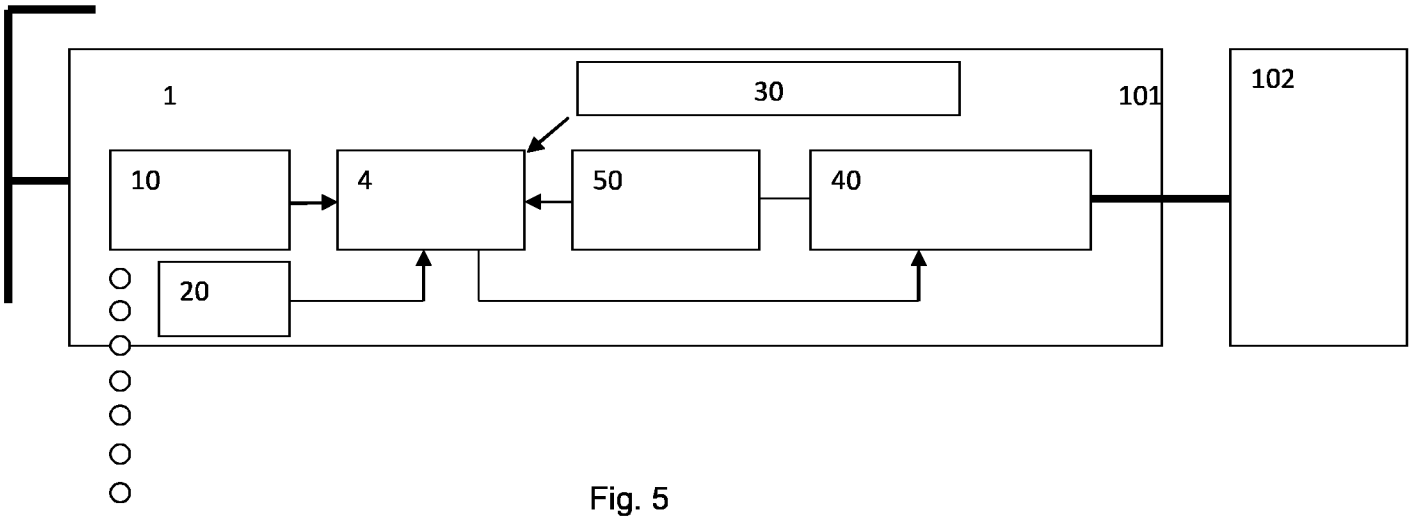
FIG. 5 shows a block diagram of the preferred embodiment of FIG. 1.

FIG. 5 shows schematically a block diagram of a device according to the invention. Device 1 comprises switching means for converting pulling movements on the first operating means by a user into first electrical signals. The switching means preferably comprise an electric switch and a mechanical actuator for the electric switch, which is connected to the first operating means. Suitable switching means are for instance the switching mechanism 10. Device 1 is further provided with second operating means 20 for generating second electrical signals. Second operating means 20 can preferably be manually operated and comprise an operating button, preferably a push button.

Motor 40 and power supply 30 are situated in motor housing 101 of motor unit 100. Motor housing 101 further comprises measuring means 50 for determining a setting value associated with a current position of the screen. Suitable measuring means comprise an encoder, which preferably measures the rotation of the primary shaft of the electric motor using a sensor such as a Hall sensor.

Device 1 further comprises a data memory for saving the setting values. Device 1 preferably comprises a microcontroller 4 in which are incorporated the control means, the program memory, the data memory and input and output ports (I/O) for communication with peripheral equipment, such as measuring means 50 and switching means 10 and operating button 20. After receiving the second electrical signals, device 1 will save the current position of the screen as a first or a second end position. The movement of the screen is bounded by the end positions.

In the shown preferred embodiment microcontroller 4, measuring means 50 and motorized drive 40 are incorporated in an electrical circuit with a power supply 30. Power supply 30 is preferably a current source, such as battery, which is preferably rechargeable. First operating means 10 generate the first electrical signals by closing the electrical circuit in the ON-mode and breaking the electrical circuit in the OFF-mode. The first electrical signals comprise information about the pulling movements, such as the number of pulling movements, duration of a pulling movement, duration between successive pulling movements, order of pulling movements or combinations thereof.

Second operating means 20 likewise generate the second electrical signals by closing the electrical circuit. The second electrical signals comprise information about the pushing movements, such as the number of pushing movements, duration of a pushing movement, duration between successive pushing movements, order of pushing movements or combinations thereof.

Device 1 comprises means for controlling the motorized drive. The control means receive the first electrical signals from the switching means and can translate these signals into commands for the motorized drive. Device 1 comprises a program memory in which the instructions for processing the first electrical signals are saved.

According to the invention, device 1 can be programmed manually by means of first operating means 3 and/or second operating means 20.

Control means 4 are configured for this purpose to save the setting value associated with the current position of the screen in the data memory after receiving the second electrical signals. These control means comprise a second set of additional instructions for processing the second electrical signals. This second set of additional instructions is preferably saved in the program memory of the microcontroller.

Control means 4 are further configured to save the setting value associated with the current position of the screen as an intermediate position in the data memory after receiving predetermined first electrical signals.

These control means comprise a first set of additional instructions for processing the predetermined first electrical signals. This first set of additional instructions is preferably saved in the program memory of the microcontroller.

Figure 6:
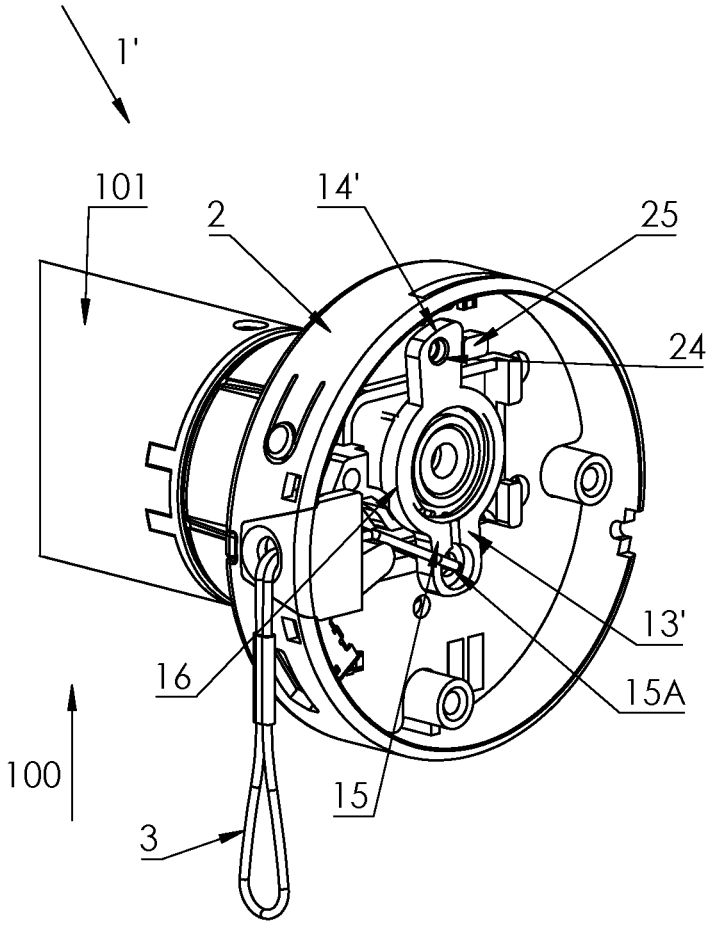
FIG. 6 shows a schematic view of a second preferred embodiment of the device according to the invention with broken-away parts.

FIG. 6 shows a schematic view of a second preferred embodiment of the device according to the invention with broken-away parts. The broken-away parts are closing plate 9 with mounting means 8 and the second housing part 12 of switching mechanism 10. These are shown in FIG. 2.

Like components of the two preferred embodiments have like reference numerals. Similar components of the two preferred embodiments are designated with the same reference numeral with added accent. Examples are device 1', rotation element 13', first lip 14'. In the case of new components with the same function the reference numerals are increased by the number 20.

Device 1' is distinguished by contactless switching means with an electric or electronic switch 25 instead of a (pressure) switch 5. Contactless switch 25 comprises a sensor, preferably a Hall sensor. The switching element or rotation element 13' comprises a number of magnets. In the shown second preferred embodiment rotation element 13' comprises a magnet 24 which is arranged on the first radially protruding lip 14'. Lip 14' does not require chamfering. The Hall sensor measures a magnetic field and converts it into a control signal. The sensor functions as wireless and contactless receiver. As alternative to the Hall sensor, other sensors which measure other physical quantities, for instance radiation, are in principle also suitable to form the contactless switch. The associated co-acting wireless and contactless signal generators, for instance magnet 24 or a radiation source, are generally mounted on a mechanically movable switching element. In the first and second preferred embodiment the switching element is a rotation element. The switching element can however also be a translation element, for instance a slide, or consist of a plurality of parts movable relative to each other.

In both preferred embodiments the switching means comprise a switch (sensor 25 or (pressure) switch 5), which generates a first electrical signal in a first mode and generates a second electrical signal in a second mode. In the first mode the first electrical signal can be zero and the switch is in the OFF-mode. In the second mode the second electrical signal can differ from zero and the switch is in the ON-mode. In both preferred embodiments the switching means further comprise a switching element, such as rotation element 13, 13', for connection to first operating means 3. Switching element 13, 13' is movable between a first mode, in which the switch is in the first position, and a second mode in which the switching element activates the switch in the second position.

In device 1' rotation element 13' is rotatable about a rotation axis R which runs substantially parallel to the longitudinal axis of tubular motor housing 101. In assembled state this longitudinal axis runs parallel to the screen shaft, i.e. the shaft of the roller blind tube. The operation of the device according to the invention is illustrated on the basis of the following examples with method steps.

EXAMPLE 1: OPERATING A SCREEN WITHOUT PROGRAMMED END POSITIONS

As long as a user operates first operating means 3 by means of a first pulling movement (for instance pulls the pull cord continuously), the motor runs and the screen moves.

Performing the first pulling movement again results in a reversal of the direction in which the motor runs, whereby the screen moves in the opposite direction.

EXAMPLE 2: PROGRAMMING AN END POSITION

Operating the second operating means 20 with a first pushing movement at the position where the motor is stationary results in the current screen position being programmed as first end position.

The device optionally generates a confirmation signal when an end position has been saved successfully. An example of a confirmation signal is the motor moving back and forth once. A light signal is another example. The screen has to be moved to a second end position, after which the foregoing steps can be repeated for programming the second end position.

EXAMPLE 3: OPERATING A SCREEN WITH PROGRAMMED END POSITIONS

When a user operates the first operating means with a second pulling movement (for instance 1 short pull) when the motor is stationary, the screen moves to one of the two end positions.

The motor stops when the second pulling movement is repeated.

Performing the second pulling movement again results in a reversal of the rotation direction of the motor, whereby the screen moves in the opposite direction, to the other end position.

EXAMPLE 4: DELETING ALL POSITIONS

Operating the second operating means 20 with a second pushing movement (for instance pushing continuously for a prolonged period of time, such as 5 seconds) results in the memory being cleared. The control means return to the factory values.

The device optionally generates the confirmation signal when the memory is in danger of being cleared (for instance after 2 seconds).

The device optionally generates the confirmation signal again when the memory has been successfully cleared (for instance after 5 seconds).

EXAMPLE 5: PROGRAMMING AN INTERMEDIATE POSITION

Operating the first operating means with a third pulling movement (for instance pulling continuously for a determined period of time, such as 5 seconds) results in the current screen position being programmed as intermediate position.

The device optionally generates the confirmation signal when the intermediate position has been saved successfully.

EXAMPLE 6: OPERATING A SCREEN WITH PROGRAMMED INTERMEDIATE POSITION

When a user operates the first operating means with a fourth pulling movement (for instance pulling continuously for a determined period of time, such as 2 seconds, or two short pulls) when the motor is stationary, the screen moves to the intermediate position.

EXAMPLE 7: DELETING AN INTERMEDIATE POSITION

Performing the third pulling movement when the current screen position is the intermediate position results in the intermediate position being cleared from the memory.

The device optionally generates the confirmation signal when the intermediate position has been successfully cleared from the memory.

The control means preferably comprise software for evaluating the first electrical signals coming from the first operating means and for evaluating the second electrical signals coming from the second operating means, and for generating commands for controlling the motor or saving the setting value associated with the current position of the screen when predetermined first or second electrical signals are received/recognized. A skilled person in the field will be able to develop suitable software after reading of this text.

Although the first operating means are illustrated in the shown preferred embodiment as a pull cord, it will be apparent to a skilled person in the field that they can also be formed by alternative manual operating means, including a chain or a rod.

The invention is illustrated on the basis of a motor unit for a roller blind.

The device according to the invention is however applicable to diverse types of screen with a motorized drive. A skilled person in the field will be able to effect co-action of the device according to the invention with diverse suitable motors and transmissions of screens, such as window coverings, after reading of this text.

The invention is expressly not limited to the described and shown embodiment, but comprises all variants thereof which fall within the scope of protection of the appended claims, as seen in the light of the accompanying figures.

The invention claimed is:

1. A motorized drive of a window covering provided with a device for manually operating the motorized drive, said device comprising a housing to be attached to a shaft of the window covering;

first operating means for manual operation of the device by means of pulling movements by a user;

switching means for converting the pulling movements on the first operating means into first electrical signals for the motorized drive, wherein the switching means comprise a switch which does not generate first electrical signals in a first mode and generates first electrical signals in a second mode, wherein the switching means further comprise a switching element for connection to the first operating means, wherein the switching element is movable between a first position, in which the switch takes up the first mode, and a second position in which the switching element activates the switch in the second mode, and the device comprises control means for controlling the motorized drive on the basis of the first electrical signals, wherein the switch is electrically connected with the control means and wherein the control means comprise a first set of instructions for processing the first electrical signals, wherein the device is further provided with second manual operating means for generating second electrical signals and a data memory for saving setting values, wherein the control means are configured to save a setting value associated with a current position of the window covering in the data memory after receiving the first electrical signals, wherein the control means comprise a second set of additional instructions for processing the second electrical signals, wherein the control means are configured to save a setting value associated with a current position of the window covering in the data memory after receiving the second electrical signals.

2. The motorized drive as claimed in claim 1, wherein the switch is configured to close an electrical circuit in which a power supply and the motorized drive are incorporated.

3. The motorized drive as claimed in claim 1, wherein the control means comprise a microcontroller for controlling the motorized drive.

4. The motorized drive as claimed in claim 1, wherein the window covering is a roller blind and wherein the motorized drive is further provided with a motor unit which is coupled to the housing, wherein the motor unit comprises a tubular motor housing for the motorized drive, which is to be received in a roller blind tube.

5. The motorized drive as claimed in claim 1, wherein the second operating means comprises an operating button.

6. The motorized drive as claimed in claim 5, wherein the second operating means comprises a push button.

7. The motorized drive as claimed in claim 1, wherein the switching element is a rotation element, wherein the rotation element is rotatable about a rotation axis running substantially parallel to the shaft of the window covering.

8. The motorized drive as claimed in claim 7, comprising biasing means for urging the rotation element into the first position.

9. The motorized drive as claimed in claim 7, wherein the rotation element comprises a central body with a first radially protruding lip.

10. The motorized drive as claimed in claim 9, wherein the rotation element comprises a central body with a second radially protruding lip for connection to the first operating means.

11. The motorized drive as claimed in claim 1, wherein the switch comprises a sensor and the switching element comprises a number of associated signal generators.

12. The motorized drive as claimed in claim 11, wherein the switch comprises a magnetic sensor and the switching element comprises a number of magnets.

13. The motorized drive as claimed in claim 12, wherein the magnetic sensor is a Hall sensor.

14. The motorized drive as claimed in claim 12, wherein the rotation element comprises a central body with a first radially protruding lip and one or more of the magnets are arranged on the first radially protruding lip.

15. A method for saving setting values associated with different positions of a window covering, wherein window covering is provided with a motorized drive and a device for manually operating the motorized drive of the window covering, said device comprising a housing to be attached to a shaft of the window covering; first operating means for manual operation of the device by means of pulling movements by a user; switching means for converting the pulling movements on the first operating means into first electrical signals for the motorized drive, wherein the switching means comprise a switch which does not generates first electrical signals in a first mode and generates first electrical signals in a second mode, wherein the switching means further comprise a switching element for connection to the first operating means, wherein the switching element is movable between a first position, in which the switch takes up the first mode, and a second position in which the switching element activates the switch in the second mode, and the device comprises control means for controlling the motorized drive on the basis of the first electrical signals, wherein the switch is electrically connected with the control means and wherein the control means comprise a first set of instructions for processing the first electrical signals, wherein the device is further provided with second manual operating means for generating second electrical signals, a data memory for saving setting values, wherein the control means is configured to save a setting value associated with a current position of the window covering in the data memory after receiving the first electrical signals, wherein the control means comprise a second set of additional instructions for processing the second electrical signals, wherein the control means are configured to save a setting value associated with a current position of the window covering in the data memory after receiving the second electrical signals, said method comprising the step of saving a current position of the window covering by manually operating the first operating means and said method comprising the further step of saving a current position of the window covering by manually operating the second operating means.

* * * * *